US008506049B2

(12) United States Patent
Kakutani

(10) Patent No.: US 8,506,049 B2
(45) Date of Patent: Aug. 13, 2013

(54) PRINTING DEVICE

(75) Inventor: Toshiaki Kakutani, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 22 days.

(21) Appl. No.: 13/249,117

(22) Filed: Sep. 29, 2011

(65) Prior Publication Data

US 2012/0081461 A1 Apr. 5, 2012

(30) Foreign Application Priority Data

Sep. 30, 2010 (JP) ..... 2010-220112

(51) Int. Cl.
*B41J 2/21* (2006.01)

(52) U.S. Cl.
USPC ..... 347/43

(58) Field of Classification Search
USPC ..... 347/43
See application file for complete search history.

(56) References Cited

U.S. PATENT DOCUMENTS 5,846,306 A * 12/1998 Kubota et al. ..... 106/31.75
6,102,537 A * 8/2000 Kato et al. ..... 347/101
6,655,797 B2 * 12/2003 Smith et al. ..... 347/98
6,902,249 B2 * 6/2005 Suzuki et al. ..... 347/15
7,407,277 B2 8/2008 Yoneyama
2006/0158481 A1 * 7/2006 Spevak et al. ..... 347/43
2007/0076069 A1 * 4/2007 Edwards et al. ..... 347/100
2009/0244137 A1 10/2009 Kakutani
2009/0322814 A1 12/2009 Sano

FOREIGN PATENT DOCUMENTS

JP 2009-234170 A 10/2009
JP 2010-005878 A 1/2010

* cited by examiner

*Primary Examiner* — Matthew Luu
*Assistant Examiner* — Michael Konczal
(74) *Attorney, Agent, or Firm* — Maschoff Brennan

(57) ABSTRACT

A printer provided in which a printing head is relatively scanned in a main scanning direction or a sub-scanning direction with respect to a printing medium to perform printing. The printing head includes a color ink nozzle row in which a plurality of nozzles ejecting a color ink are arranged in the sub-scanning direction, a first white ink nozzle row and a second white nozzle row in which a plurality of nozzles ejecting white ink are arranged in the sub-scanning direction. The second white nozzle row is different from the first white ink nozzle row. The first white ink nozzle row is provided at a position overlapping with the color ink nozzle row in the main scanning direction. The second white ink nozzle row is provided at a position which does not overlap with the color ink nozzle row in the main scanning direction.

12 Claims, 11 Drawing Sheets

FIRST PRINTING MODE
(PRINTING MEDIUM: TRANSLUCENT PRINTING MEDIUM)

SECOND PRINTING MODE
(PRINTING MEDIUM: TRANSLUCENT PRINTING MEDIUM)

THIRD PRINTING MODE
(PRINTING MEDIUM: NON-TRANSLUCENT PRINTING MEDIUM)

SECOND PRINTING MODE

FIRST AND THIRD PRINTING MODES

SECOND PRINTING MODE

FIRST AND THIRD PRINTING MODES

FIRST PRINTING MODE
(PRINTING MEDIUM: TRANSLUCENT PRINTING MEDIUM)

SECOND PRINTING MODE
(PRINTING MEDIUM: TRANSLUCENT PRINTING MEDIUM)

THIRD PRINTING MODE
(PRINTING MEDIUM: NON-TRANSLUCENT PRINTING MEDIUM)

PRINTING DEVICE

Priority is claimed under 35 U.S.C §115 to Japanese Application No. 2010-220112 filed on Sep. 30, 2010 which is hereby incorporated by reference in its entirety.

BACKGROUND

1. Technical Field

The present invention relates to a printing device, and more particularly, to a printing device in which a printing head is relatively scanned in a main scanning direction and a sub-scanning direction with respect to a printing medium to perform printing.

2. Related Art

Hitherto, a printing method is known in which a light shield ink is used to perform printing in order to raise visibility of a printing image by suppressing a translucency and a light diffusion property of a printing image area when printing is performed on a printing medium having the translucency and the light diffusion. As a technique relating to a printing device which performs printing using the light shield ink, for example, JP-A-2010-05878 is known.

The printing device based on the technique described above has a printing head provided with three nozzle rows ejecting an ink in a sub-scanning direction. Improvement in the technique is demanded in order to further reduce the size of the printing.

SUMMARY

An advantage of some aspects of the invention is to reduce the size of a printing head of a printing device capable of ejecting a light shield ink.

The invention may take the following aspects or applications to solve at least a part of the problem.

Application 1

According to a first aspect of the invention, there is provided a printing device in which a printing head is relatively scanned in a main scanning direction or a sub-scanning direction with respect to a printing medium to perform printing, wherein the printing head includes a color ink nozzle row in which a plurality of nozzles ejecting a color ink are arranged in the sub-scanning direction, a first light shield ink nozzle row in which a plurality of nozzles ejecting a light shield ink are arranged in the sub-scanning direction, and a second light shield ink nozzle row in which a plurality of nozzles ejecting a light shield ink are arranged in the sub-scanning direction, which is different from the first light shield ink nozzle row, wherein the first light shield ink nozzle row is provided at a position overlapping with the color ink nozzle row in the main scanning direction, and wherein the second light shield ink nozzle row is provided at a position which does not overlap with the color ink nozzle row in the main scanning direction.

According to the printing device of the aspect of the invention, in the printing head, the first light shield ink nozzle row of two light shield nozzle ink rows formed of the nozzles ejecting the light shield ink is provided at the position overlapping with the color ink nozzle row in the main scanning direction, and thus it is possible to reduce the structural size of the printing head as compared with a printing device provided with a printing head having a structure provided with light shield ink nozzle rows at two parts between which the color ink nozzle row is interposed therebetween in the sub-scanning direction.

Application 2

In the printing device according to Application 1, the printing device performs printing based on any one of a first printing mode and a second printing mode, the printing based on the first printing mode is printing based on the ejection of the color ink using the nozzles included in the color ink nozzle row and ejection of the light shield ink using the nozzles included in the second light shield ink nozzle row, and the printing based on the second printing mode is printing based on the ejection of the color ink employing a first nozzle group formed of a predetermined number of nozzles included in the color ink nozzle row and ejection of the light shield ink employing a second nozzle group formed of a predetermined number of nozzles provided at a position which does not overlap with the first nozzle group in the main scanning direction in the nozzles included in the first light shield ink nozzle row and on the side farther away from the second light shield ink nozzle row than the first nozzle group in the sub-scanning direction.

According to the printing device of the aspect of the invention, it is possible to perform the printing on the basis of two kinds of printing modes of the first printing mode and the second printing mode.

Application 3

In the printing device according to Application 2, it is preferable that the second light shield ink nozzle row is provided on the front side of the proceeding direction of the printing head relative to the printing medium in the sub-scanning direction as compared with the first light shield ink nozzle row.

According to the printing device of the aspect of the invention, as the first printing mode, the light shield ink is applied in a predetermined printing area by the second light shield ink nozzle row, and then the color ink can be applied in the same area by the color ink nozzle row. In addition, as the second printing mode, the color ink is applied in a predetermined printing area by the first nozzle group, and then the light shield ink can be applied in the same area by the second nozzle group.

Application 4

In the printing device according to Application 3, it is preferable that, in the printing based on the first printing mode, the light shield ink is ejected from the nozzles included in the second light shield ink row onto the printing medium to form a light shield ink layer, and then the color ink is ejected from the nozzles included in the color ink nozzle row onto the printing medium to laminate and form a color ink layer on the light shield ink layer, and in the printing based on the second printing mode, the color ink is ejected from the nozzles of the first nozzle group onto the printing medium to form a color ink layer, and then the light shield ink is ejected from the nozzles of the second nozzle group onto the printing medium to laminate and form a light shield ink layer on the color ink layer.

According to the printing device of the aspect of the invention, when the printing medium has a translucency or a light diffusion property, the printing is performed on the basis of the first printing mode to view a printing image from a printing face, thereby suppressing the translucency or the light diffusion property of the printing image itself. In addition, when the printing medium has the translucency, the printing is performed on the basis of the second printing mode to view a printing image from the opposite side to the printing face, thereby suppressing the translucency of the printing image itself.

Application 5

In the printing device according to Application 2, it is preferable that the second light shield ink nozzle row is provided on the rear side of the proceeding direction of the printing head relative to the printing medium in the sub-scanning direction as compared with the first light shield ink nozzle row.

According to the printing device of the aspect of the invention, as the first printing mode, the color ink is applied in a predetermined printing area by the color ink nozzle row, and then the light shield ink can be applied in the same area by the light shield ink nozzle row. In addition, as the second printing mode, the light shield ink is applied in a predetermined printing area by the second nozzle group, and then the color ink can be applied in the same area by the first nozzle group.

Application 6

In the printing device according to Application 5, it is preferable that in the printing based on the first printing mode, the color ink is ejected from the nozzles included in the color ink nozzle row onto the printing medium to form a color ink layer, and then the light shield ink is ejected from the nozzles included in the second light shield ink nozzle row onto the printing medium to laminate and form a light shield ink layer on the color ink layer, and in the printing based on the second printing mode, the light shield ink is ejected from the nozzles of the second nozzle group onto the printing medium to form a light shield ink layer, and then the color ink is ejected from the nozzles of the first nozzle group onto the printing medium to laminate and form a color ink layer on the light shield ink layer.

According to the printing device of the aspect of the invention, when the printing medium has a translucency, the printing is performed on the basis of the first printing mode to view a printing image from the opposite side to the printing face, thereby suppressing the translucency of the printing image itself. In addition, when the printing medium has the translucency or a light diffusion property, the printing is performed on the basis of the second printing mode to view a printing image from the printing face, thereby suppressing the translucency or the light diffusion property of the printing image itself.

Application 7

In the printing device according to any one of Applications 1 to 6, it is preferable that the light shield ink be a white ink.

According to the printing device of the aspect of the invention, since the white ink is used as the light shield ink, it is possible to secure brightness of the printing image.

Application 8

In the printing device according to any one of Applications 1 to 6, it is preferable that the light shield ink be a metallic ink having metallic luster.

According to the printing device of the aspect of the invention, since the metallic ink is used as the light shield ink, it is possible to give the printing image texture having a metal luster.

Application 9

In the printing device according to any one of Applications 1 to 8, it is preferable that the printing medium be a printing medium having a translucency.

According to the printing device of the aspect of the invention, since it is possible to perform printing on the printing medium having the translucency, it is possible to perform the printing when the printing image is viewed from the printing face and the printing when the printing image is viewed from the opposite side to the printing face.

Application 10

In the printing device according to any one of Applications 1 to 8, it is preferable that the printing medium be a non-translucent printing medium.

According to the printing device, it is possible to perform printing on the non-translucent printing medium. In addition, it is possible to perform printing on the printing medium having the light diffusion property, as the non-translucent printing medium.

Application 11

The printing device according to any one of Applications 2 to 10 may further have a third printing mode, wherein the printing based on the third printing mode is printing based on the ejection of the color ink and the light shield ink using the nozzles of each nozzle row which is not used in the second printing mode in the nozzles included in the color ink nozzle row and the first light shield ink nozzle row, and the printing device is capable of performing the printing based on any one of the first printing mode, the second printing mode, and the third printing mode.

According to the printing device of the aspect of the invention, it is possible to suppress a bias in the use frequency of the nozzles.

Application 12

According to another aspect of the invention, there is provided a printing device in which a printing head is relatively scanned in a main scanning direction or a sub-scanning direction with respect to a printing medium to perform printing, wherein the printing head includes a color ink nozzle row in which a plurality of nozzles ejecting a color ink are arranged in the sub-scanning direction, and a light shield ink nozzle row in which a plurality of nozzles ejecting a light shield ink are arranged in the sub-scanning direction, and wherein the light shield ink nozzle row is provided with the nozzles provided at a position overlapping with the color ink nozzle row in the main scanning direction and the nozzles provided at a position which does not overlap with the color ink nozzle row in the main scanning direction.

According to the printing device of the aspect of the invention, since the light shield ink nozzle row is provided with the nozzles provided at the position overlapping with the color ink nozzle row in the main scanning direction, it is possible to reduce the size of the printing head as compared with the printing head formed of the light shield ink nozzle row and the color ink nozzle row provided with only nozzles provided at the position which does not overlap with the color ink nozzle row in the main scanning direction.

In addition, the invention may be realized by various aspects. For example, the invention may be realized by aspects such as a printing device, a printing head, a printing system, a method of producing a printing device, a method of producing a printing head, a printing method using the printing device and the printing head, and the like.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiments of the invention will be described on the basis of examples.

A. First Example

A1. System Configuration

Figure 1:
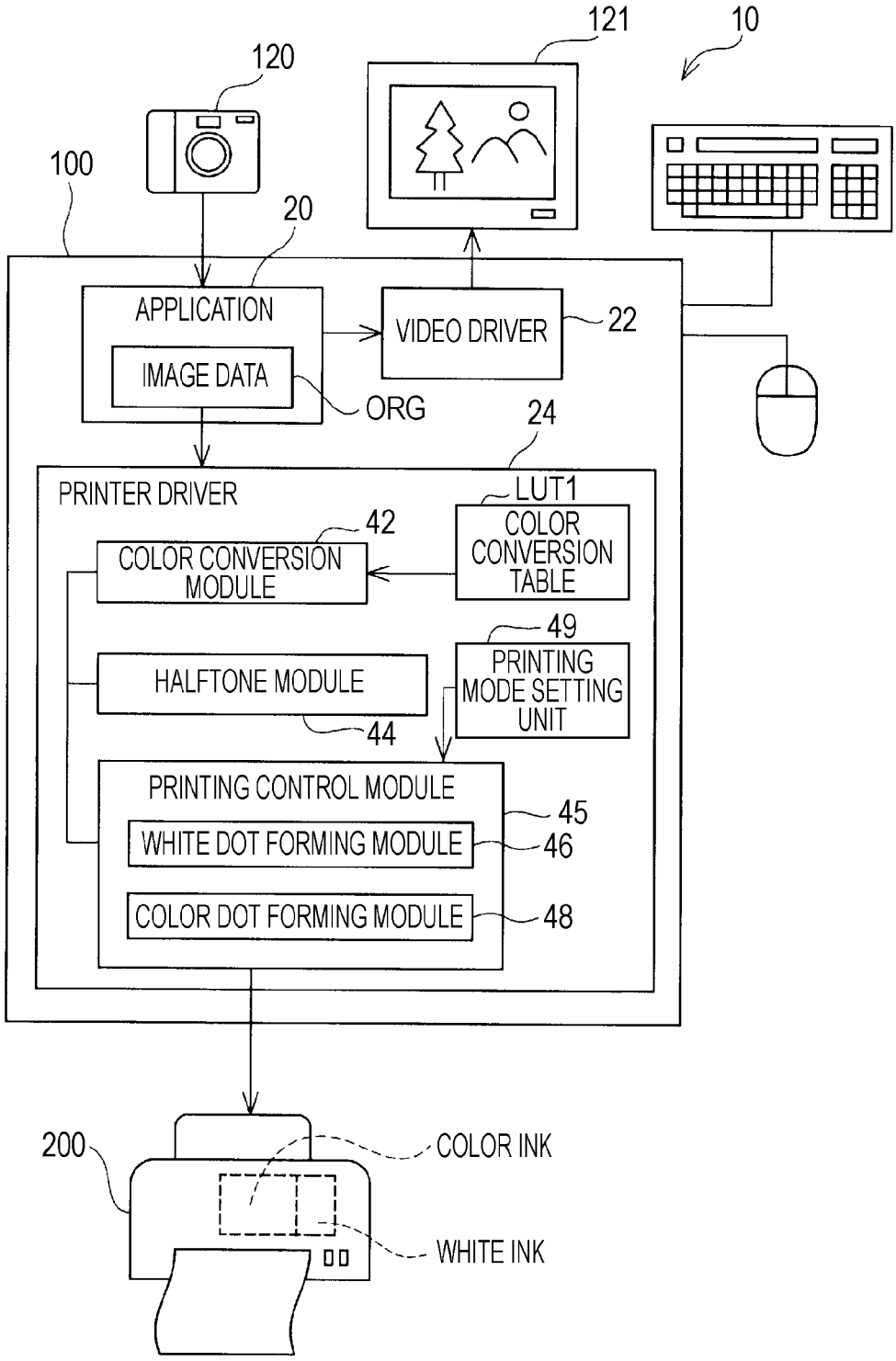
FIG. 1 is a diagram illustrating a schematic configuration of a printing system.

FIG. 1 is a diagram illustrating a schematic configuration of a printing system 10 as an embodiment of the example. As shown in FIG. 1, the printing system 10 of the example includes a computer 100 as a printing control device, and a printer 200 actually printing an image under the control of the computer 100. The printing system 10 integrally serves as a printing device in a broad sense.

The printer 200 of the example performs printing using a cyan ink (C), a magenta ink (M), a yellow ink (Y), and a black ink (K). The printer 200 is provided with a white ink (W) as a light shield ink to perform printing. The light shield ink is an ink having a translucency, and is an ink used to suppress the translucency of a printing image formed on a printing medium when the printing medium has the translucency. When the printing medium is not translucent, for example, has a light diffusion property, the light shield ink is an ink used to suppress the light diffusion property of the printing image formed on the printing medium. In addition, as the non-translucent printing medium, when a background color is a color such as red, blue, and black, or when a background color of the printing medium is white but has a special texture such as pearl white, the light shield ink is an ink used to suppress an influence caused by the background color of the printing medium itself or the texture with respect to the printing image formed on the printing medium. That is, the light shield ink is an ink applied to the printing medium to prevent the printing image formed by the color ink from being affected by the background color (including translucency, light diffusion property, and texture) of the printing medium.

In the example, although the white ink (W) is employed as the light shield ink, another color ink having the translucency may be used. For example, a color ink having the translucency, a metallic ink having metallic luster, a white ink having pearl luster, and the like may be used. In addition, a semi-translucent color ink having a light shield property may be used. In the specification, a "color ink" is used as meaning also including a black ink, but the printer 200 may have a configuration which does not include the black ink as the color ink. In this case, the black may be represented as so-called composite black using cyan, magenta, and yellow.

In the printer 200, a configuration of the computer 100 provided with printing data and supplying the printing data will be described. A predetermined operating system is installed in the computer 100, and an application program 20 is operated under the operating system. A video driver 22 and a printer driver 24 are mounted on the operating system. For example, image data ORG is input from a digital camera 120 by the application program 20. Then, the application program 20 displays an image represented by the image data ORG on a display 121 through the video driver 22. The application program 20 outputs the image data ORG to the printer 200 through the printer driver 24.

In the example, the image data ORG input from the digital camera 120 is data formed of three color components of red (R), green (G), and blue (B). The application program 20 sets areas (hereinafter, referred to as "color forming area") formed of the color components of R, G, and B with respect to an arbitrary area in the image data ORG.

The application program 20 adds data of the white ink (W) to the image data ORG input from the digital camera 120. In the example, the application program 20 applies the light shield white ink to the whole printable area in the printing medium. Hereinafter, the area where the white ink is applied is referred to as "white area". That is, in the white area, there is an area overlapping with the color forming area. The color forming area necessarily overlaps with the white area. In the example, the white area is the whole printable area of the printing medium, but the color forming area and the white area may be the same area.

The printer driver 24 receives the image data ORG from the application program 20, and converts the image data ORG into data which can be output to the printer 200. The printer driver 24 is provided with a color conversion module 42 that performs color conversion, a color conversion table LUT1 with reference to which the color conversion module 42 performs the color conversion, a halftone module 44 that performs multi-valuation of the image data after the color conversion, a printing control module 45 that converts the data after the multi-valuation into dot data of each color ink, and a printing mode setting unit 49 that performs setting for the printing control module 45. The printing control module 45 is provided therein with a white dot forming module 46 and a color dot forming module 48.

The color conversion module 42 receives the image data ORG from the application program 20, and converts RGB components into color components (cyan (C), magenta (M), yellow (Y), and black (K)) which can be represented by printer 200 in the color forming area of the image data ORG with reference to the color conversion table LUT1 prepared in advance on the basis of component data (hereinafter, also referred to as RGB components) of R, G, and B included in the image data ORG.

The halftone module 44 performs a halftone process of representing gradation of the image data converted in color by the color conversion module 42 by distribution of dots. In the example, the known structural dither method is used as the halftone process. In addition to the structural dither method, an error diffusion method, a concentration pattern method, and the other halftone technique may be used as the halftone process.

The printing control module 45 converts the formation of the ink dots into a signal instructed to the printer 200 using the data subjected to the halftone process. The color dot forming module 48 performs the dot formation based on the color ink with each color on the image subjected to the halftone process, that is, the image in the color forming area. The white dot forming module 46 forms white dots in the white area. A dot recording ratio of the white dots in the white area is set in advance as a fixed value in the white color dot forming module 46, and the white dots are formed on the fixed value.

Figure 2A:
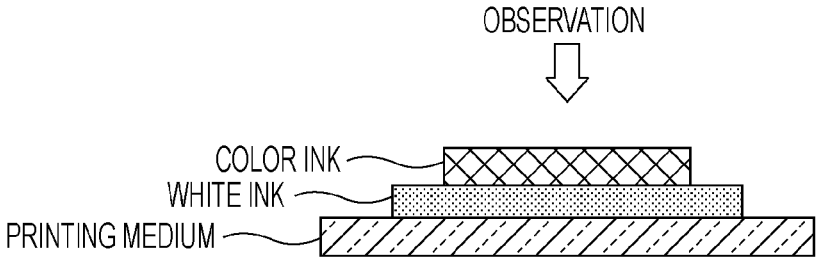
FIG. 2A to FIG. 2C are diagrams illustrating first to third printing modes.
Figure 2B:
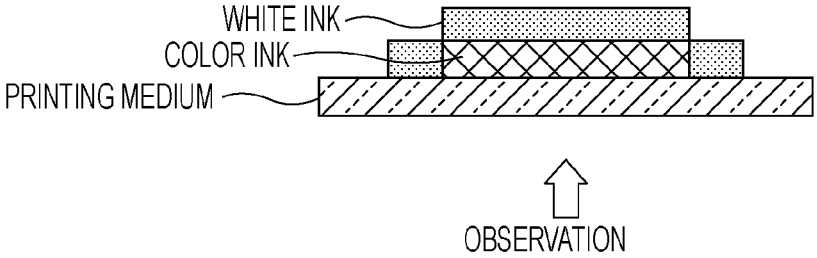
Figure 2C:
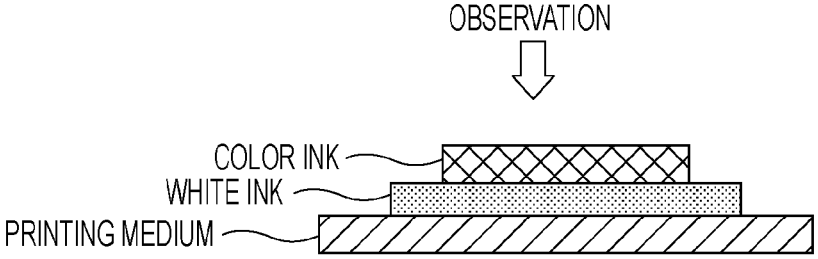

Before starting a printing process, the printing mode setting unit 49 receives an instruction that any printing mode of the first to third printing modes may be executed from a user, and sets the printing mode on the basis of the received instruction. Herein, the printing mode will be described. FIG. 2A to FIG. 2C are diagrams illustrating the first to third printing modes. FIG. 2A schematically shows a cross-sectional view of a printing medium after printing when the printing is performed in the first printing mode. The first printing mode is a printing mode used when viewing a printing image from a printing face using a translucent printing medium having a translucency in a printing medium. In the printing mode, a white ink is applied as the light shield ink to the translucent printing medium for the first time. The white ink is applied to the white area, that is, the whole printable area in the printing medium. Thereafter, the color inks (C, M, Y, and K) are applied to the color forming area.

FIG. 2B schematically shows a cross-section view of a printing medium after printing when the printing is performed in the second printing mode. The second printing mode is a printing mode used when viewing a printing image from the opposite face to the printing face using a translucent printing medium having the translucency in a printing medium. In the second printing mode, a color ink is applied to the color forming area in the translucent printing medium for the first time. Thereafter, the white ink is applied to the white area.

FIG. 2C is schematically shows a cross-sectional view of a printing medium after printing when the printing is performed in the third printing mode. The third printing mode is a printing mode used when viewing a printing image from the printing face using a non-transparent printing medium as the printing medium, for example, a paper medium or a printing medium formed of a light diffusion plastic. In the third printing mode, the sequence and the area of applying the ink to the printing medium are the same as the first printing mode described above. That is, the white ink is applied as the light shield ink to the white area in the non-translucent printing medium for the first time. Thereafter, the color inks (C, M, Y, and K) are applied to the color forming area. As will be described later, the third printing mode is different in the dot recording ratio of the white ink applied to the white area from the first and second printing modes.

Figure 3:
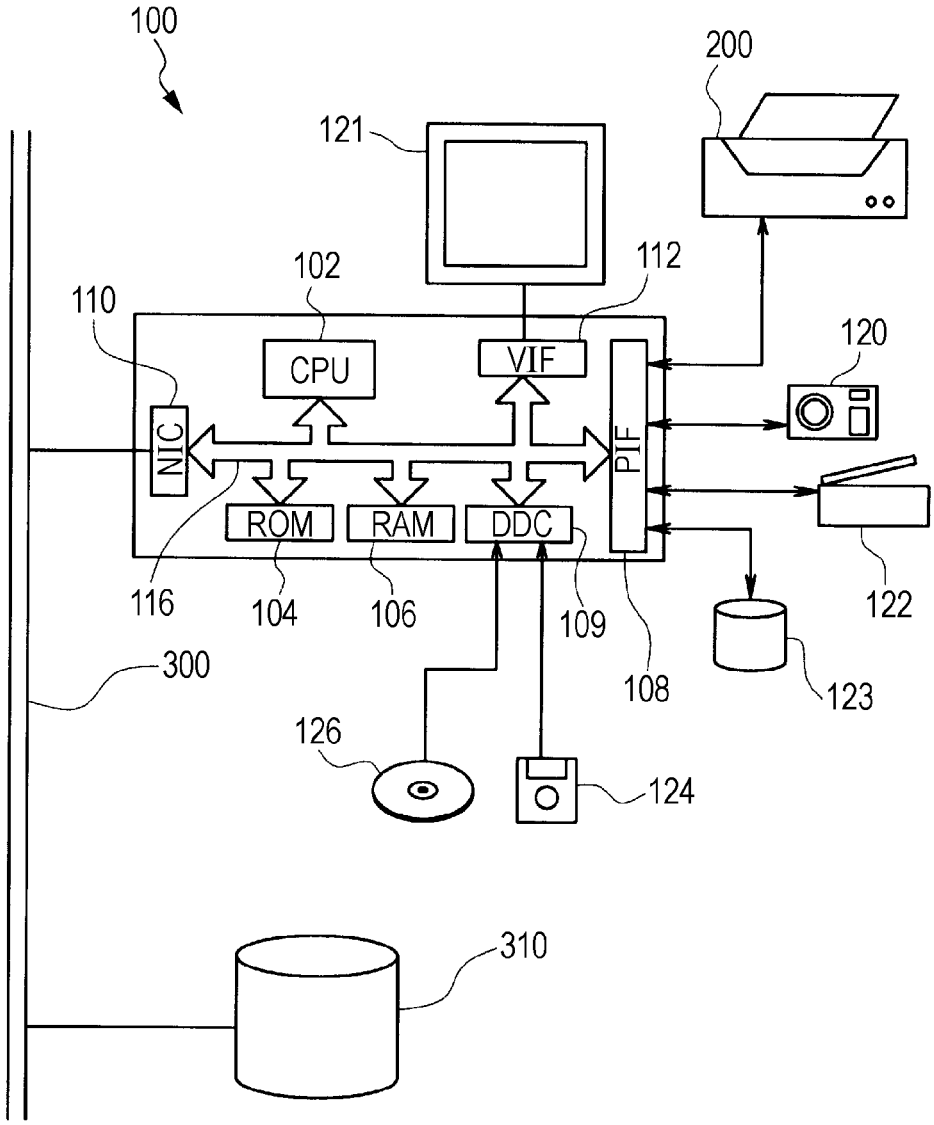
FIG. 3 is a diagram illustrating a schematic configuration of computer.

Next, a specific configuration of the computer 100 as the printing control device will be described. FIG. 3 is a diagram illustrating a schematic configuration of the computer 100. The computer 100 has the known configuration mainly including a CPU 102, in which a ROM 104, a RAM 106, and the like are connected to each other through a bus 116.

The computer 100 is connected to a disk controller 109 for reading data such as a flexible disk 124, a compact disk 126, and the like, a peripheral device interface 108 for transmitting and receiving data to and from peripheral devices, and a video interface 112 for driving a display 121. The peripheral device interface 108 is connected to the printer 200 and a hard disk 123. When the digital camera 120 and a color scanner 122 are connected to the peripheral device interface 108, an image process may be performed on an image captured by the digital camera 120 and the color scanner 122. When a network interface card 110 is mounted, data stored in a storage device 310 connected to a communication line may be acquired by connecting the computer 100 to the communication line 300. When the computer 100 acquires the image data to be printed, the computer 100 controls the printer 200 by the operation of the printer driver 24 described above to perform printing of the image data.

Figure 4:
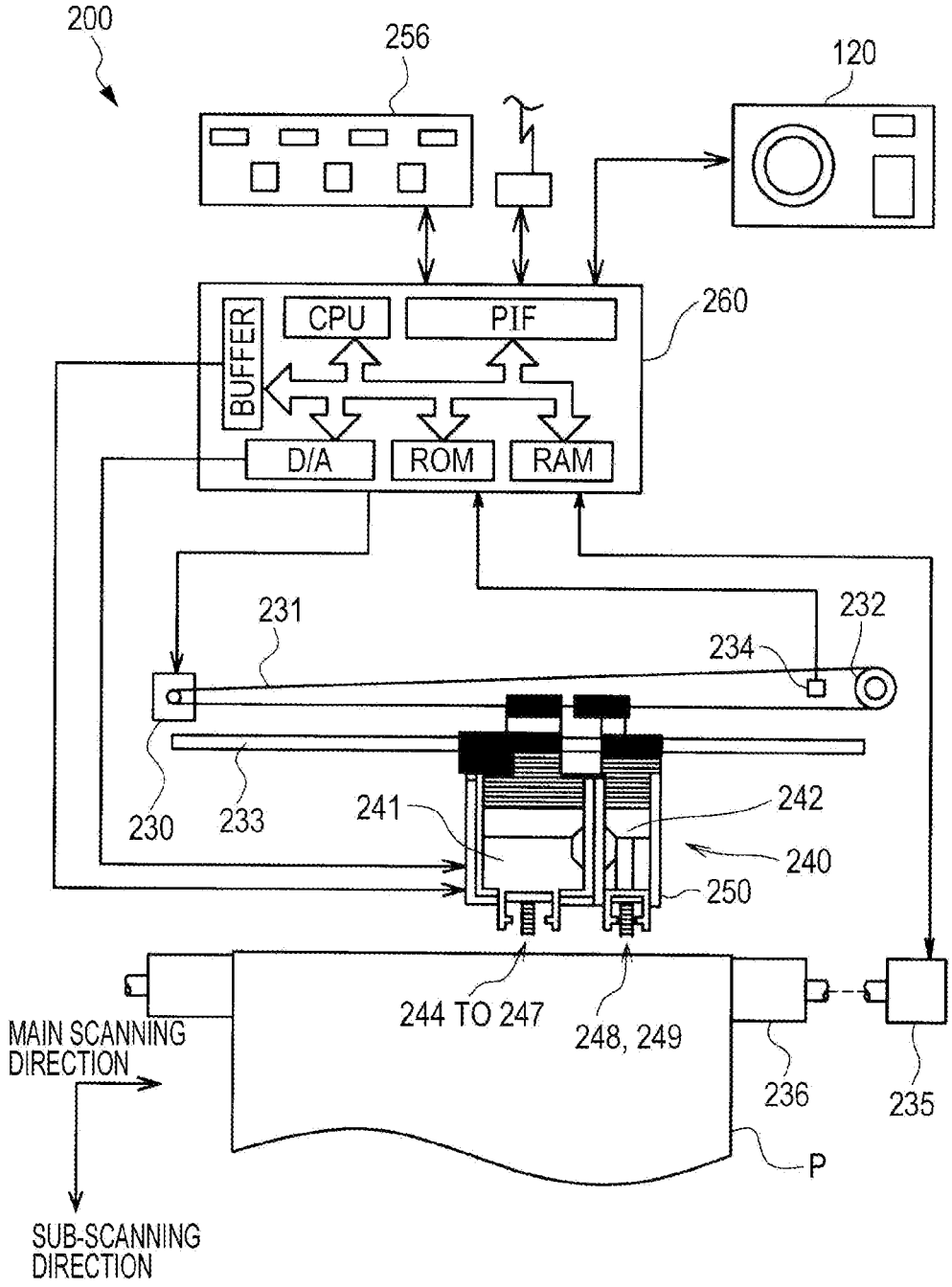
FIG. 4 is a block diagram illustrating a schematic configuration of a printer.

Next, a configuration of the printer 200 will be described. FIG. 4 is a block diagram illustrating a schematic configuration of the printer 200. As shown in FIG. 4, the printer 200 includes a mechanism transporting a printing medium P by a paper transport motor 235, a mechanism reciprocating a carriage 240 in an axial direction of a platen 236 by a carriage motor 230, a mechanism driving a printing head 250 mounted on the carriage 240 to perform ink ejection and dot formation, and a control circuit 260 interchanging signals with the printing head 250 and an operation panel 256.

The mechanism reciprocating the carriage 240 in the axial direction of the platen 236 includes a sliding shaft 233 which is provided in parallel to the shaft of the platen 236 and slidably holds the carriage 240, a pulley 232 for suspending an endless driving belt 231 to between the carriage motor 230 and the pulley 232, and a position detecting sensor 234 detecting an original position of the carriage 240.

The carriage 240 is provided with a color ink cartridge 241 containing each of a cyan ink (C), a magenta ink (M), a yellow ink (Y), and a black ink (K). The carriage 240 is provided with a white ink cartridge 242 containing a white ink (W). The printing head 250 provided at the lower portion of the carriage 240 is provided with total 5 kinds of ink ejecting heads 244 to 249 corresponding to the colors, that is, six ink ejecting heads (the number of ink ejecting heads of the white ink is two). When the ink cartridges 241 and 242 are mounted from the upside on the carriage 240, the ink can be supplied from the cartridges to the ink ejecting heads 244 to 249. Hereinafter, the printing head 250 will be described.

Figure 5:
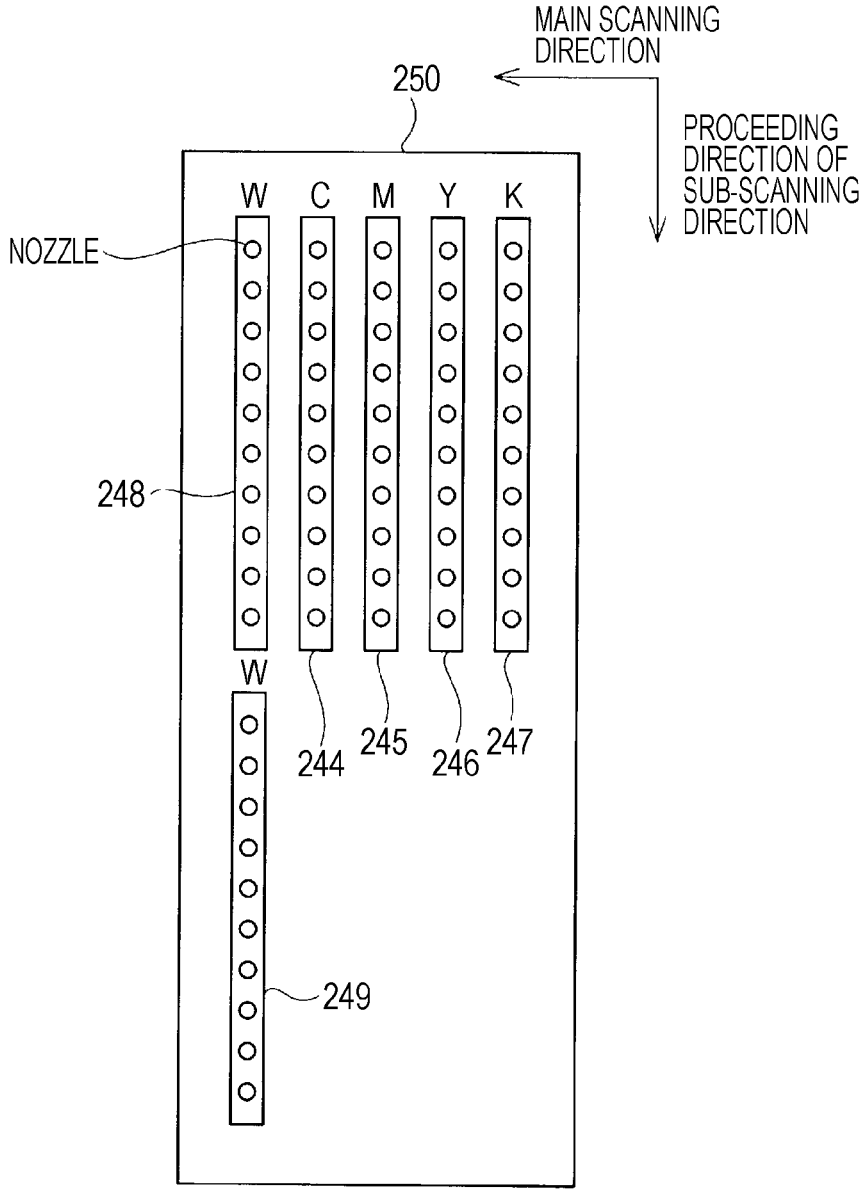
FIG. 5 is a diagram illustrating schematic nozzle arrangement of an ink ejecting head.

FIG. 5 is a diagram illustrating schematic nozzle arrangement of the ink ejecting head constituting the printing head 250. The ink ejecting head is prepared for each color of the white ink (W), the cyan ink (C), the magenta ink (M), the yellow ink (Y), and the black ink (K). Each ink ejecting head is provided on the lower face of the printing head 250. In the ink ejecting heads 244 to 247 of the cyan ink (C), the magenta ink (M), the yellow ink (Y), and the black ink (K) which are color inks, ten nozzles for each color are arranged in the sub-scanning direction, and ink droplets of each color are ejected from the nozzles. In the example, the "sub-scanning direction" is a direction perpendicular to the main scanning direction. Hereinafter, the "proceeding direction of the sub-scanning direction" means a vector component of a relative proceeding direction of the sub-scanning direction of the printing head 250 with respect to the printing medium. Accordingly, in the printing head 250 shown in FIG. 5, the printing medium P passes from the nozzles shown at the lowest portion at the printing time.

The printing head 250 is provided with two ink ejecting head 248 and ink ejecting head 249 for the white ink (W). In the ink ejecting heads 248 and 249, ten nozzles are arranged in the sub-scanning direction, and white ink droplets are ejected from the nozzles. As shown in FIG. 5, the white ink ejecting head 248 is provided at a position (an adjacent position in the example) overlapping with the color ink ejecting heads 244 to 247 in the main scanning direction. In the example, the white ink ejecting head 248 is adjacent to the color ink ejecting heads 244 to 247 in the main scanning direction, but another functional unit, an additional section, or ink ejecting nozzles may be interposed between the white ink ejecting head 248 and the color ink ejecting heads 244 to 247, and the white ink ejecting head 248 may be provided at a position overlapping with the color ink ejecting heads 244 to 247 in the main scanning direction.

The ink ejecting head 249 is provided at a position (non-adjacent position in the example) which does not overlap with the color ink ejecting heads 244 to 247 in the main scanning direction and on the front side of the proceeding direction in the sub-scanning direction from the ink ejecting head 248. In FIG. 5, it is described for the situation of drawing that each of the ink ejecting heads 244 to 249 is provided with ten nozzles, but the number of nozzles of each ink ejecting head is determined depending on specifications of the printer 200. The white ink ejecting head 249 is provided at the position which does not overlap with the color ink ejecting heads 244 to 247 in the main scanning direction, but may be an ink ejecting head having a shape in which a part of the white ink ejecting head 249 overlaps with the color ink ejecting heads 244 to 247 in the main scanning direction.

Figure 6B:
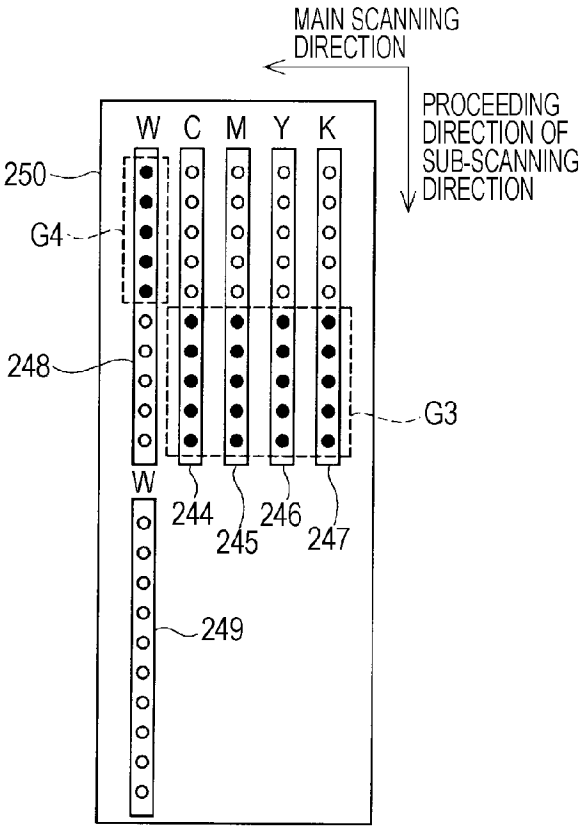
FIG. 6A and FIG. 6B are diagrams illustrating nozzles used in each printing mode.
Figure 6A:
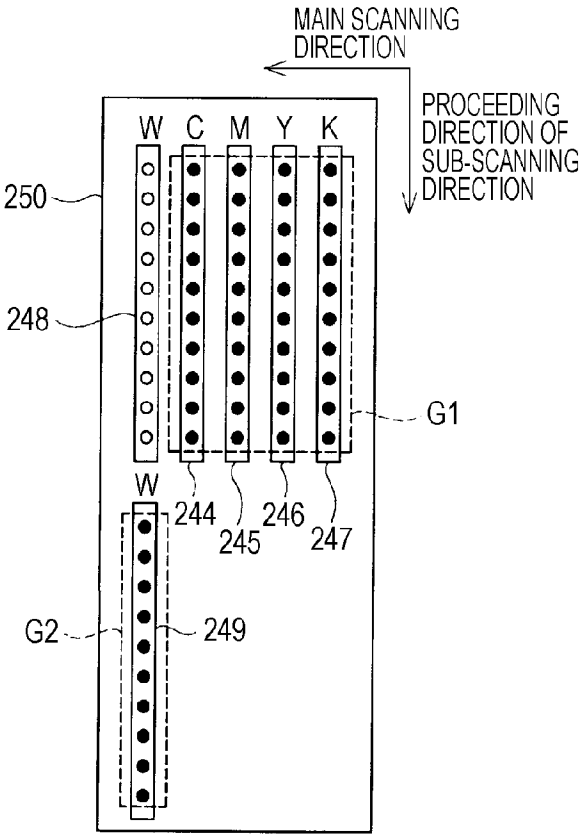

FIG. 6A and FIG. 6B are diagrams illustrating nozzles used in the first to third printing modes. FIG. 6A shows nozzles used in the first printing mode and the third printing mode as painted entirely black. When the printing is performed in the first and third modes, the printing is performed in order of the white ink and the color ink on the printing medium P. In the example, when the printing is performed in the first and third printing modes, the color ink ejecting heads 244 to 247 and the white ink ejecting head 249 are used for the nozzles used in the printing head 250.

As for the color ink, the printing is performed using all the nozzles (ten nozzles in the example) of each of the ink ejecting heads 244 to 247. The nozzle group of the color ink used in the first and third printing modes is represented as a nozzle group G1 in FIG. 6A. Meanwhile, as for the white ink, all the nozzles (ten nozzles in the example) of the ink ejecting head 249 are used. The nozzle group of the white ink used in the first and third printing modes is represented as a nozzle group G2 in FIG. 6A.

The printing head 250 is scanned using the nozzles as described above to perform the printing, the white ink is thereby applied to the printing medium P for the first time, and then the color ink is applied. As described above, the printing is performed in the first and third printing modes. In addition, in the first and third printing modes of the example, the printing is performed using all the nozzles of the ink ejecting heads 244 to 247 and 249, but the printing may be performed using an arbitrary number of nozzles equal to or more than one, of the nozzles of each ink ejecting head.

FIG. 6B shows the nozzles used in the second printing mode, as nozzles painted entirely black. When the printing is performed in the second printing mode, the printing is performed in order of the color ink and the white ink on the printing medium P. In the example, when the printing is performed in the second printing mode, the color ink ejecting heads 244 to 247 and the white ink ejecting heads 248 are used for the nozzles used in the printing head 250.

As for the color ink, a half number (five nozzles from the leading in the example) of the nozzles of the ink ejecting heads 244 to 247 from the front side of the proceeding direction in the sub-scanning direction are used. The nozzle group of the color ink used in the second printing mode is shown as a nozzle group G3 in FIG. 6B. Meanwhile, a half number (the later five nozzles in the example) of nozzles of the ink ejecting head 248 from the rear side of the proceeding direction in the sub-scanning direction are used. The nozzle group of the white ink used in the second printing mode is shown as a nozzle group G4 in FIG. 6B.

The printing head 250 is scanned using the nozzles as described above to perform the printing, the color ink is thereby applied to the printing medium P for the first time, and then the white ink is applied. As described above, it is possible to perform the printing in the second printing mode. In the second printing mode of the example, the printing is performed using the half number of nozzles of the ink ejecting heads 244 to 247 from the front side of the proceeding direction in the sub-scanning direction and the half number of nozzles of the ink ejecting head 248 from the rear side of the proceeding direction in the sub-scanning direction, but the printing may be performed using arbitrary nozzles from the nozzles positioned on the further front side than the nozzles on the last nozzle in the sub-scanning direction on the nozzles of the ink ejecting heads 244 to 247 as a nozzle group G3 and using a predetermined number of nozzles positioned on the rear side in the sub-scanning direction from the nozzle group G3 in the nozzles of the ink ejecting head 248 as a nozzle group G4.

A piezoelectric element is used for ejection of ink from the nozzles shown in FIG. 6A and FIG. 6B. As known, the piezoelectric element is an element in which a crystal structure is distorted by applying voltage and which performing electric-mechanical energy conversion at a very high speed. In the example, a predetermined voltage signal (driving signal) is applied to the piezoelectric element to deform one side wall of ink channels in the nozzles, thereby ejecting ink droplets from the nozzles. In the example, the ink is ejected using the piezoelectric element as described above, but a method of generating bubbles in the nozzles to eject the ink may be employed.

The control of the printing head 250 described above is performed by the control circuit 260 of the printer 200 shown in FIG. 4. The control circuit 260 is configured in which a CPU, a ROM, a RAM, a PIF (peripheral device interface), and the like are connected to each other through a bus, the operation of the carriage motor 230 and the paper transport motor 235 is controlled to perform the control of the main scanning operation and the sub-scanning operation of the carriage 240. When the control circuit 260 receives the printing data output from the computer 100 through the PIF, the driving signal corresponding to the printing data is supplied to the ink ejecting heads 244 to 249 to control the ejection of ink when the carriage 240 moves forward in the main scanning direction or moves backward in the main scanning direction, thereby performing printing of a predetermined raster. When the forward movement or backward movement accompanying the ejection of ink is performed to the end of the main scanning direction of the printing medium P, the control circuit 260 transports the printing medium P in the sub-scanning direction and waits for the printing of the next raster. This operation is repeated, and thus the printer 200 completes the printing in the first to third printing modes.

It is described that the printer 200 of the example is a so-called ink jet printer forming ink dots by ejecting ink droplets toward the printing medium P, but may be a printer applying ink to the printing medium using the other method. For example, a printer applying ink by attaching toner powder of colors to a printing medium using electrostatics instead of ejecting ink droplets, a thermal transfer printer, or a sublimation printer may be embodied.

A2. Printing Process

Next, the printing process performed by the printing system 10 will be described. Before starting the printing process, a user performs printing setting, using a printing setting screen displayed on the display 121 (FIG. 1) by the application program 20. The user performs designation of the first to third printing modes as the printing setting. After the designation of the printing mode, when the user operates a printing start button displayed on the display 121, the printing system 10 starts the printing process.

Figure 7:
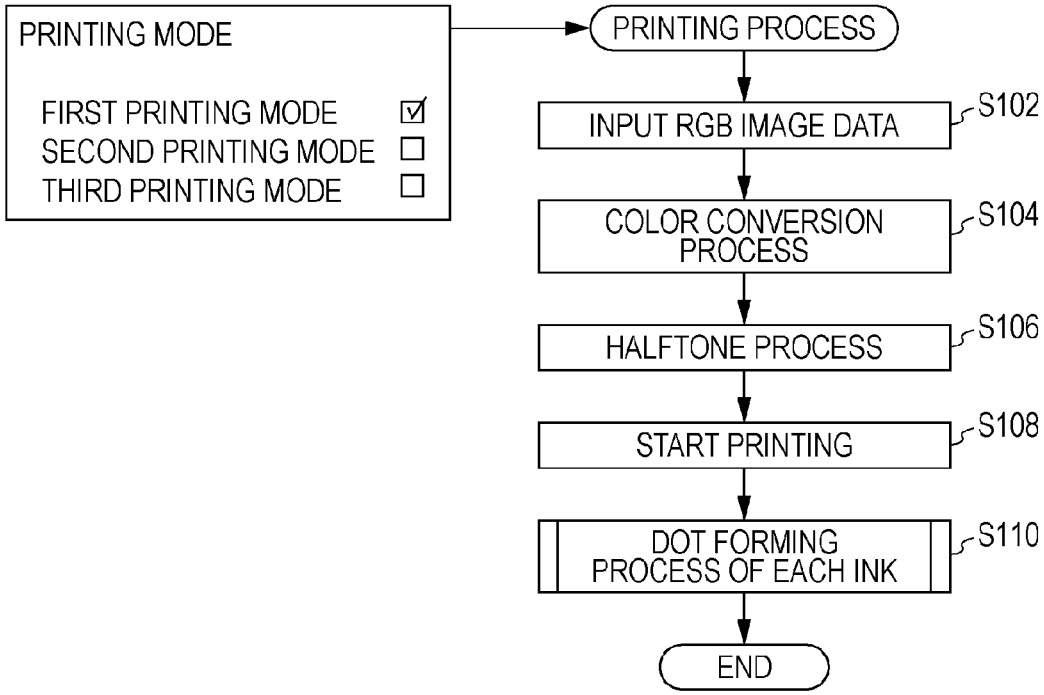
FIG. 7 is a flowchart illustrating a flow of a printing process.

FIG. 7 is a flowchart illustrating a flow of the printing process performed by the printing system 10. When the printing process is started, the printer driver 24 inputs RGB type image data (hereinafter, merely referred to as RGB data) (Step S102). When the RGB data is input, the printer driver 24 starts the color conversion process using the color conversion module 42 (Step S104). Specifically, the input RGB data is converted into CMYK type image data. When the CMYK type image data is obtained, the computer 100 generates data which can be transmitted to the printer 200 using the halftone module 44 (Step S106). In the halftone process, a binarization process is performed on not only the color ink but also the white ink (W). In the example, in the case of the first printing mode or the second printing mode, the halftone process is performed on the white ink such that the dot recording ratio of the white area is constantly 80%. In the case of the third printing mode, the halftone process is performed on the white ink such that the dot recording ratio of the white area is constantly 70%. In the case of the third printing mode, since the printing medium is not translucent, it is possible to suppress the influence of the background color of the printing medium or the texture even when the dot recording ratio of the white ink is lower than that of the first and second printing mode.

When the halftone process is ended, the computer 100 controls the printer 200 using the printing control module 45 to start printing (Step S108). When the printing is started, the printer 200 performs a process of forming dots of each ink (Step S110). The process of forming the dots of each ink is performed as follows throughout the whole range where the image is formed on the printing medium P.

First and Third Printing Modes

In the first printing mode and the third printing mode, the dot recording ratios of the white ink applied to the printing medium and the white area are different from each other as described above. The other content of the printing process is the same. Any side is a printing mode to view the printing image from the printing face. In the printing process based on the first printing mode, the printing medium is translucent. In the printing process based on the third printing mode, the printing medium is not translucent. When the first or third printing mode is set at the time of starting the printing process by the printing mode setting unit 49, the dots of each ink are formed as follows.

When the first or third printing mode is designated, the control circuit 260 controls the ink ejecting heads 244 to 247 and 249 according to the reciprocating movement of the carriage to perform ejection of the inks. Considering one raster, (1) the white ink ejected from the nozzle group G2 (FIG. 6A) for the first time is applied to the printing medium P, and then (2) the color ink ejected from the nozzle group G2 (FIG. 6A) is applied. As a result, first, the white ink is applied to form a white ink layer, and the color inks of color (C, M, Y, and K) are applied to form a color ink layer thereon.

Second Printing Mode

The second printing mode is a printing mode for viewing the printing image from the opposite side to the printing face. In the printing process based on the second printing mode, the printing medium has a translucency. When the second printing mode is set at the time of starting the printing process by the printing mode setting unit 49, the dots of each ink are formed as follows.

When the second printing mode is designated, the control circuit 260 controls the ink ejecting heads 244 to 247 and 248 according to the reciprocating movement of the carriage to perform ejection of the inks. Considering one raster, (1) the color ink ejected from the nozzle group G3 (FIG. 6B) for the first time is applied to the printing medium P, and then (2) the white ink ejected from the nozzle group G4 (FIG. 6B) is applied. As a result, first, the color inks (C, M, Y, and K) are applied to form a color ink layer, and the white ink is applied to form a white ink layer thereon.

As described above, the printing head 250 of the printing system 10 in the example is provided with the ink ejecting head 248 provided at the position (the adjacent position in the example) overlapping with the color ink ejecting heads 244 to 247 in the main scanning direction, and the ink ejecting head 249 provided at the position which does not overlap with the color ink ejecting heads 244 to 247 in the main scanning direction. Accordingly, it is possible to reduce the structural size as compared with the printing head of the structure provided with the ink ejecting heads which eject the light shield ink at two parts between which the ink ejecting head ejecting the color ink is interposed in the sub-scanning direction.

The printing system 10 in the example performs printing using the nozzle group G1 and the nozzle group G2 in the first and third printing mode to form the white ink layer and then to form the color ink layer. When such printing is performed, the printing is performed using all the nozzles (respectively ten nozzles in the example) of the used ink ejecting heads 244 to 247 and 249. Meanwhile, in the second printing mode to form the color ink layer and then to form the white ink layer, the printing system 10 performs the printing using the nozzle group G3 and the nozzle group G4. When such printing is performed, the printing is performed using a half number (respectively five nozzles in the example) of the nozzles of the ink ejecting heads 244 to 247 and 248. Accordingly, in the first and third printing modes, it is possible to perform the printing at the higher speed than that of the second printing mode. This is effective when the use frequency by the user in the first and third printing modes is higher than that of the second printing mode. That is, since it is possible to keep the size of the printing head 250 small while securing the high speed process of printing in the printing mode with the high use frequency, it is possible to reduce costs.

Figure 8B:
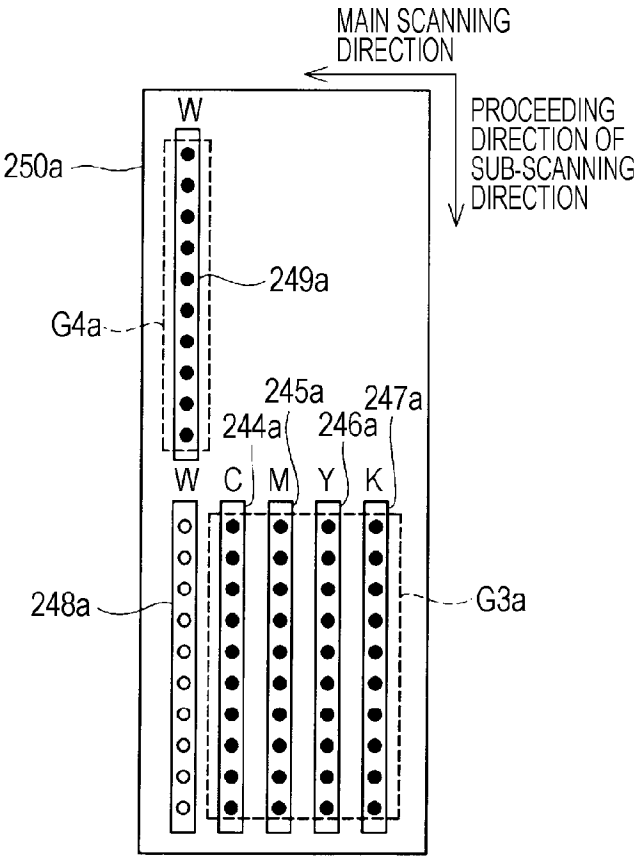
FIG. 8A and FIG. 8B are diagrams illustrating a printing head.
Figure 8A:
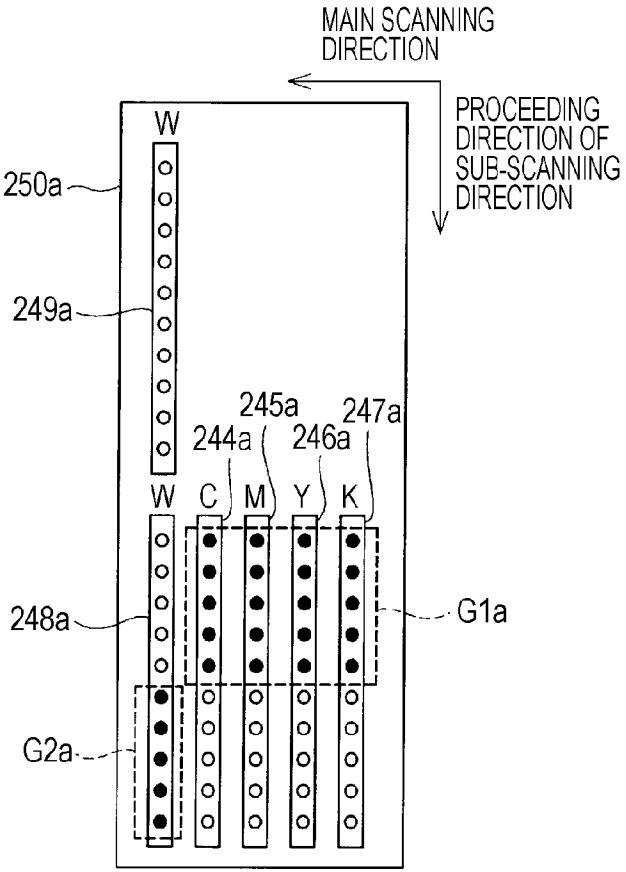

When the use frequency by the user in the second printing mode is higher than that of the first and third printing modes, a configuration of a printing head described in FIG. 8A and FIG. 8B of Modified Example 1 is employed, and thus it is possible to keep the size of the printing head small while securing the high speed process of printing in the second printing mode with the high use frequency.

As correspondence between the example and Claims, the ink ejecting heads 244 to 247 correspond to the color ink nozzle rows described in Claims, the ink ejecting head 248 corresponds to the first light shield ink nozzle row described in Claims, and the ink ejecting head 249 corresponds to the second light shield ink nozzle row described in Claims. The printing (see FIG. 6A) based on the first and third printing modes in the example corresponds to the printing based on the first printing mode described in Claims, and the printing (see FIG. 6B) based on the second printing mode in the example corresponds to the printing based on the second printing mode described in Claims.

B. Modified Example

The invention is not limited to the examples or the embodiments described above, and may be variously embodied within the scope without deviating from the concept, and for example, the following modification may be employed.

B1. Modified Example 1

In the example described above, the configuration described in FIG. 5, and FIG. 6A to FIG. 6C is employed, but the other configuration may be employed. FIG. 8A and FIG. 8B are diagrams illustrating a configuration of a printing head 250*a* as Modified Example 1. The printing head 250*a* is provided with a white ink ejecting head 249*a* which does not overlap with color ink ejecting heads 244*a* to 247*a* in the main scanning direction, on the further rear side of the proceeding direction in the sub-scanning direction than the ink ejecting heads 244*a* to 247*a*. When the printing is performed in the first and third printing modes, the printing is performed using a color ink nozzle group G1*a* and a white ink nozzle group G1*a* as shown in FIG. 8A. Meanwhile, when the printing is performed in the second printing mode, the printing is performed using a color ink nozzle group G1*a* and a white ink nozzle group G4*a* as shown in FIG. 8B. Accordingly, in the second printing mode, it is possible to perform the printing at a higher speed than the first and the third printing modes. This is effective when the use frequency by the user in the second printing mode is higher than that of the first and third printing modes. That is, since it is possible to keep the size of the printing head 250 small while securing the high speed process of printing in the printing mode with the high use frequency, it is possible to reduce costs.

Figure 9A:
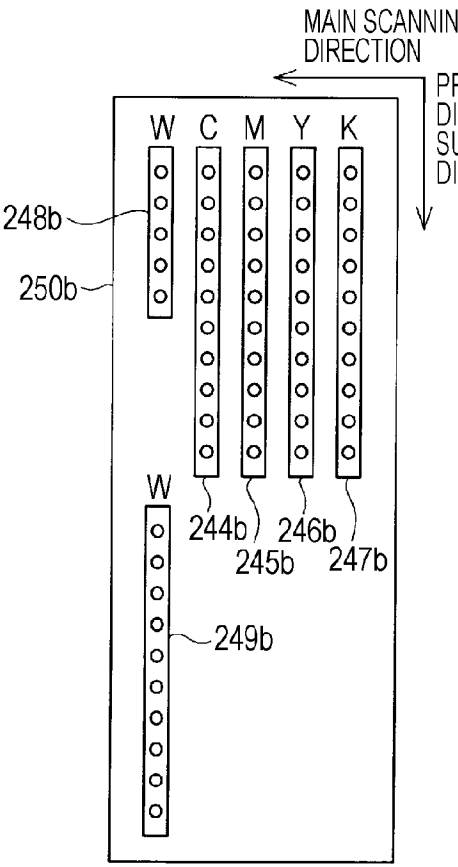
FIG. 9A to FIG. 9C are diagrams illustrating printing heads.
Figure 9B:
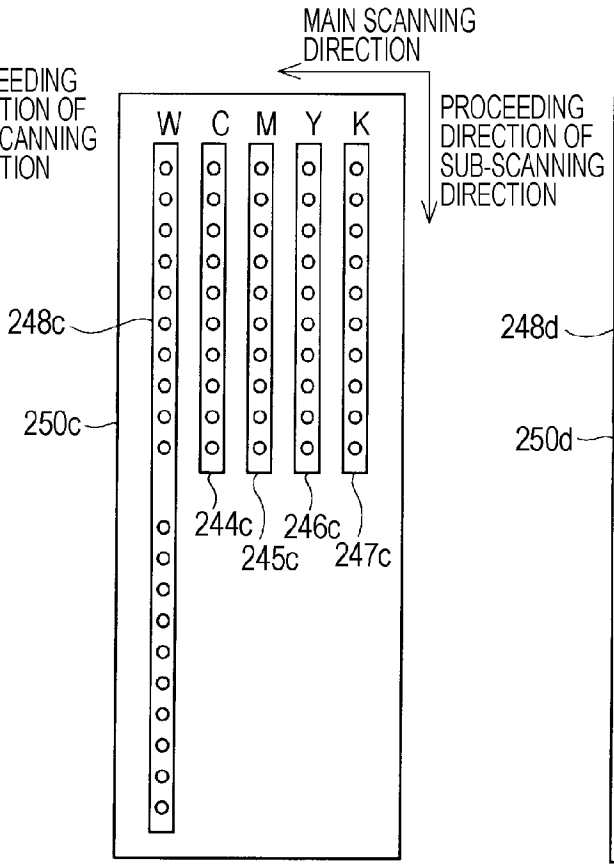
Figure 9C:
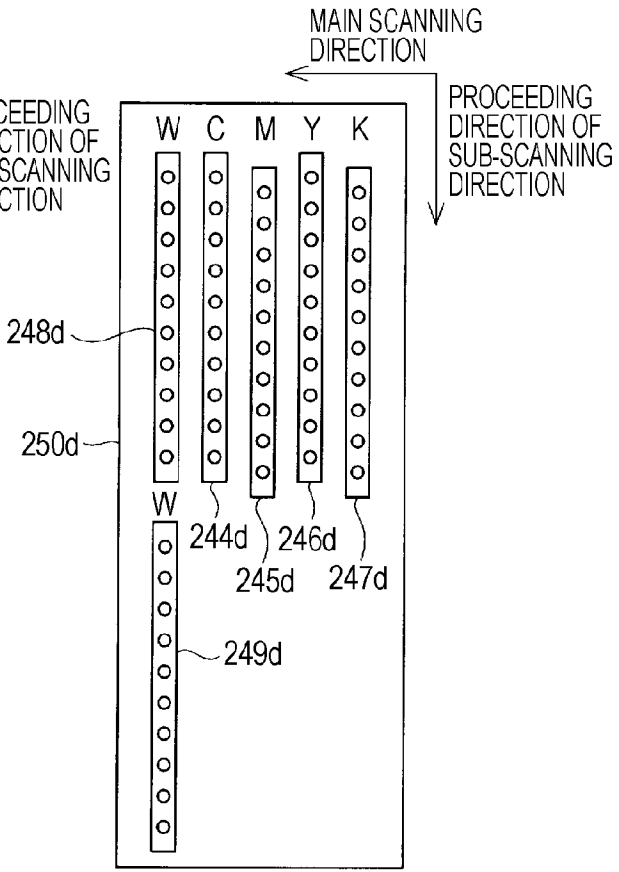

In addition, a configuration of a printing head shown in FIG. 9A to FIG. 9C may be employed. The printing head shown in FIG. 9A has a configuration in which the nozzles which are not used in any of the first to third printing modes are omitted in the white ink ejecting head 248 (FIG. 6A and FIG. 6B) in the first example. That is, a first half of nozzles (five nozzles from the front side of the proceeding direction in the sub-scanning direction in the modified example) of the proceeding direction in the sub-scanning direction in the nozzles of the ink ejecting head 248 are omitted. By employing such a configuration of the printing head, it is possible to further achieve simplification of the structure, reduction in size, and low costs of the printing head in addition to the advantages described in the example described above.

The printing head shown in FIG. 9B employs a configuration in which the ink ejecting head 248 and the ink ejecting head 249 in the first example are integrated into one ink ejecting head 248*c*. Even when such a configuration of the printing head is employed, it is possible to obtain the same advantages as the example described above.

The printing head shown in FIG. 9C employs a configuration in which color ink ejecting heads are provided to deviate from each other in the sub-scanning direction and the nozzles are in zigzag pattern. Even when such a configuration of the printing head is employed, it is possible to obtain the same advantages as the example described above.

B2. Modified Example 2

In the example described above, the printing system 10 performs the printing in the first to third printing modes. However, a printing system in Modified Example 2 further has a printing mode of printing in which the white ink is not used to form the white ink layer but the white ink is ejected at the same time as ejecting the color ink to form one ink layer with the color ink and the white ink, as a fourth printing mode. That is, the white ink is considered as the ink equivalent to the color ink. By using the white ink as described above, it is possible to expand a so-called gamut giving a color range which can be expressed as a printing image.

Figure 10:
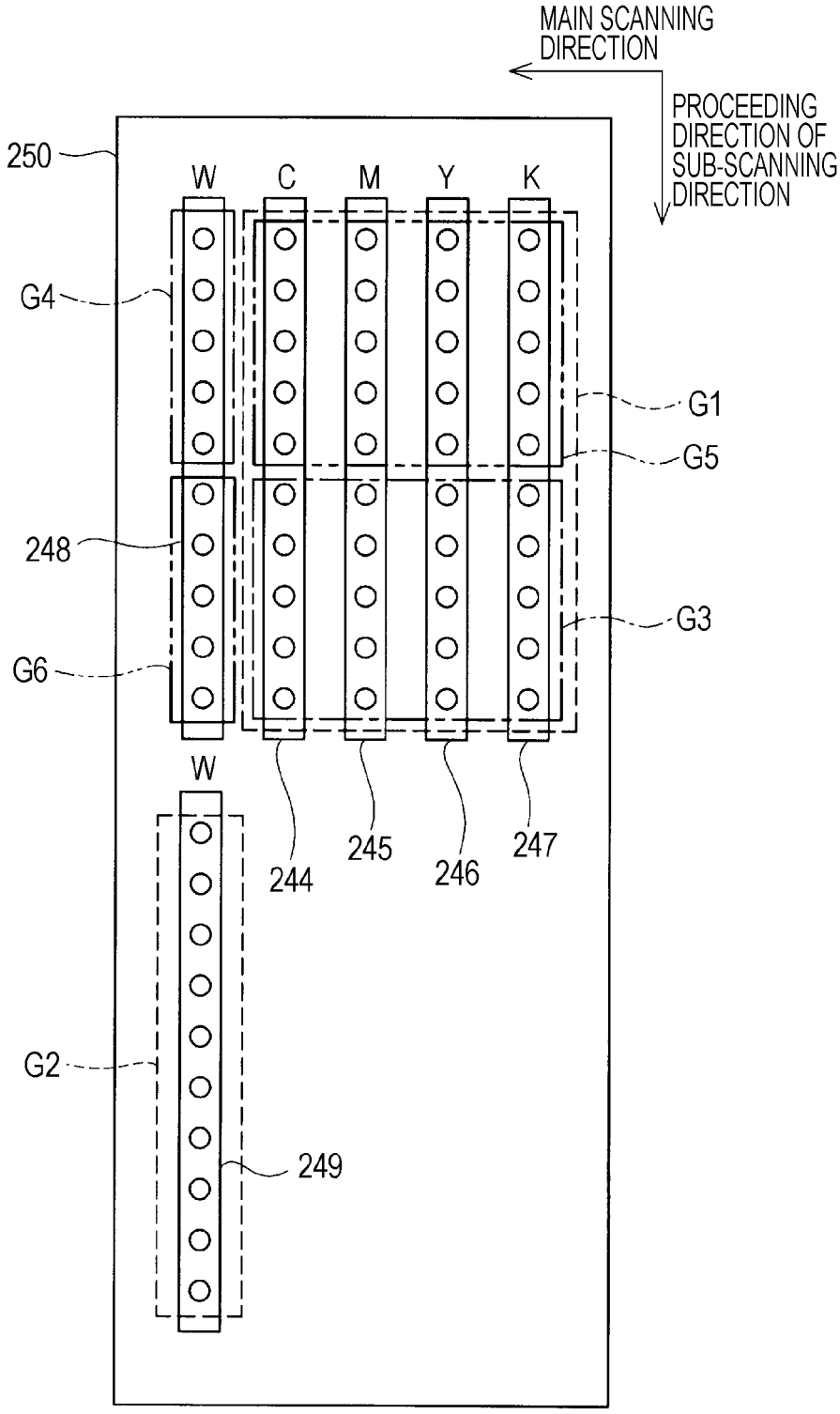
FIG. 10 is a diagram illustrating a modified example 2.

When the printing based on the fourth printing mode is performed, the printing is performed using a nozzle group G5 and a nozzle group G6 shown in FIG. 10. That is, the nozzle group G5 formed of a second half number (five nozzles from the rear side of the proceeding direction in the sub-scanning direction in the example) of nozzles of the proceeding direction in the sub-scanning direction of the color ink ejecting heads 244 to 247, and the nozzle group G6 formed of a first half number (five nozzles from the front side of the proceeding direction in the sub-scanning direction in the example) of nozzles of the proceeding direction in the sub-scanning direction of the white ink ejecting head 248 are used. In other words, the printing is performed using the nozzles which are not used in the second printing mode in the nozzles of the ink ejecting heads 244 to 247 and 248. By employing such a method of using the nozzles, it is possible to reduce the difference in use frequency in the nozzles. In addition, the fourth printing mode in Modified Example 2 corresponds to the third printing mode described in Claims.

B3. Modified Example 3

Figure 11A:
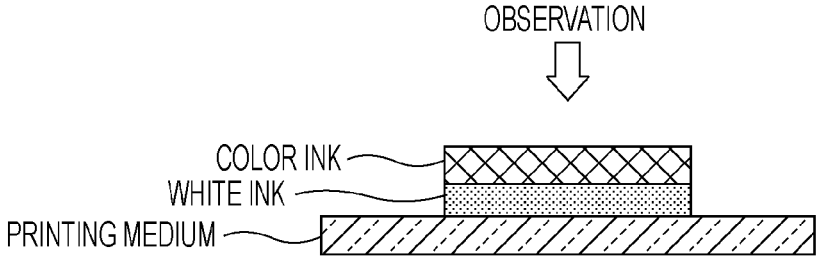
FIG. 11A to FIG. 11C are diagrams illustrating a modified example 3.
Figure 11B:
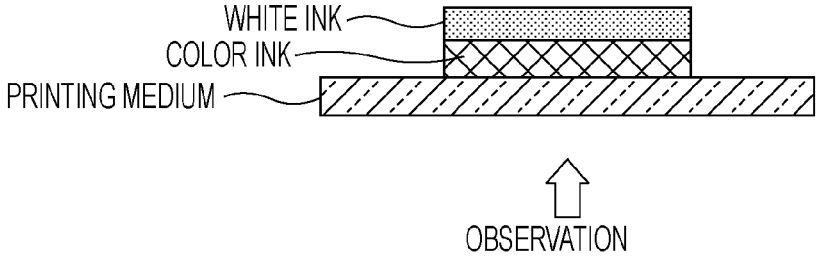
Figure 11C:
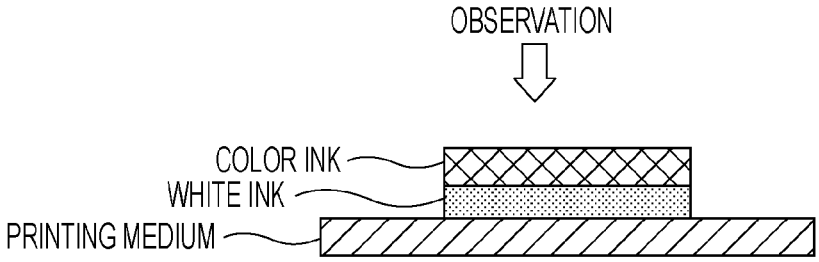

In the example described above, the white area where the white ink is applied is the whole printable area in the printing medium as described in FIG. 2A to FIG. 2C, but the white area may be the same area as the color forming area as shown in FIG. 11A to FIG. 11C. In the printing process, when the color ink dots are formed on the basis of the CMYK type image data subjected to the halftone process (FIG. 7: Step S106) by the color dot forming module 48, the modified example may be realized by performing a process such that the white dot forming module 46 forms the same dots as the dots formed by the color dot forming module 48, with the white ink. Alternatively, the white area may be smaller than the color forming area. With such a configuration, the user can visually recognize the printing image without visually recognizing the white ink. That is, it is possible to perform printing while taking out characteristics of the printing medium such as the translucence or the light diffusion property.

B4. Modified Example 4

In the example, the white ink is used as the light shield ink, but the invention is not limited thereto, and any ink with the other color having a light shield property may be used. For example, a color ink having a light shield property, a metallic ink having metallic luster, and a white ink having pearl luster may be used. A semi-translucent ink having a light shield property may be used. Even with such a configuration, it is possible to obtain the same advantages as those of the example described above.

B5. Modified Example 5

In the example described above, the printing system 10 has the first to third printing modes, but the printing system 10 may have only the first printing mode and the second printing mode. Even with such a configuration, it is possible to obtain the same advantages as those of the example described above.

B6. Modified Example 6

In the example described above, the dots with each kind of size are formed from the color ink and the white ink by the white dot forming module 46 and the color dot forming module 48, but dots which are two kinds of small and large dots or three kinds of large, medium, and small dots may be formed by the color ink and the white ink. That is, the pixels may be classified into 3 values (no dot, large dot, and small dot) or 4 values (no dot, large dot, medium dot, and small dot) according to the size of the gradation data in the pixels input as the image data, and the dots based on the gradation values may be formed. With such a configuration, it is possible to print a more delicate image in addition to the advantages of the example described above.

B7. Modified Example 7

In the example described above, the color inks are four kinds of C, M, Y, and K, but the invention is not limited thereto, and the color inks may be deep and light inks. For example, inks of deep cyan (C), light cyan (LC), deep magenta (M), and light magenta (LM), and the like may be provided, and the deep ink and the light ink may be used by classification according to the size of each gradation value of the image data. With such a configuration, it is possible to perform printing based on more delicate gradation expression in addition to the advantages of the example described above.

What is claimed is:

1. A printing device in which a printing head is scanned in a main scanning direction which intersects a sub-scanning direction relative to a printing medium to perform printing, wherein the printing head includes a color ink nozzle row in which a plurality of nozzles ejecting a color ink are arranged in the sub-scanning direction, a first light shield ink nozzle row in which a plurality of nozzles ejecting a light shield ink are arranged in the sub-scanning direction, and a second light shield ink nozzle row in which a plurality of nozzles ejecting a light shield ink are arranged in the sub-scanning direction, which is different from the first light shield ink nozzle row, wherein the first light shield ink nozzle row is provided at a position overlapping with the color ink nozzle row in the main scanning direction, and wherein the second light shield ink nozzle row is provided at a position which does not overlap with the color ink nozzle row in the main scanning direction.

2. The printing device according to claim 1, wherein the printing device performs printing based on any one of a first printing mode and a second printing mode, wherein the printing based on the first printing mode is printing based on ejection of the color ink using the nozzles included in the color ink nozzle row and ejection of the light shield ink using the nozzles included in the second light shield ink nozzle row, and wherein the printing based on the second printing mode is printing based on ejection of the color ink employing a first nozzle group formed of a predetermined number of nozzles included in the color ink nozzle row and ejection of the light shield ink employing a second nozzle group formed of a predetermined number of nozzles provided at a position which does not overlap with the first nozzle group in the main scanning direction in the nozzles included in the first light shield ink nozzle row and on the side farther away from the second light shield ink nozzle row than the first nozzle group in the sub-scanning direction.

3. The printing device according to claim 2, wherein the second light shield ink nozzle row is provided on the front side of the proceeding direction of the printing head relative to the printing medium in the sub-scanning direction as compared with the first light shield ink nozzle row.

4. The printing device according to claim 3, wherein in the printing based on the first printing mode, the light shield ink is ejected from the nozzles included in the second light shield ink row onto the printing medium to form a light shield ink layer, and then the color ink is ejected from the nozzles included in the color ink nozzle row onto the printing medium to laminate and form a color ink layer on the light shield ink layer, and wherein in the printing based on the second printing mode, the color ink is ejected from the nozzles of the first nozzle group onto the printing medium to form a color ink layer, and then the light shield ink is ejected from the nozzles of the second nozzle group onto the printing medium to laminate and form a light shield ink layer on the color ink layer.

5. The printing device according to claim 2, wherein the second light shield ink nozzle row is provided on the rear side of the proceeding direction of the printing head relative to the printing medium in the sub-scanning direction as compared with the first light shield ink nozzle row.

6. The printing device according to claim 5, wherein in the printing based on the first printing mode, the color ink is ejected from the nozzles included in the color ink nozzle row onto the printing medium to form a color ink layer, and then the light shield ink is ejected from the nozzles included in the second light shield ink nozzle row onto the printing medium to laminate and form a light shield ink layer on the color ink layer, and wherein in the printing based on the second printing mode, the light shield ink is ejected from the nozzles of the second nozzle group onto the printing medium to form a light shield ink layer, and then the color ink is ejected from the nozzles of the first nozzle group onto the printing medium to laminate and form a color ink layer on the light shield ink layer.

7. The printing device according to claim 1, wherein the light shield ink is a white ink.

8. The printing device according to claim 1, wherein the light shield ink is a metallic ink having metallic luster.

9. The printing device according to claim 1, wherein the printing medium is a printing medium having a translucency.

10. The printing device according to claim 1, wherein the printing medium is a non-translucent printing medium.

11. The printing device according to claim 2, further comprising a third printing mode, wherein the printing based on the third printing mode is printing based on ejection of the color ink and the light shield ink using the nozzles of each nozzle row which is not used in the second printing mode in the nozzles included in the color ink nozzle row and the first light shield ink nozzle row, and wherein the printing device is capable of performing the printing based on any one of the first printing mode, the second printing mode, and the third printing mode.

12. A printing device in which a printing head is scanned in a main scanning direction which intersects a sub-scanning direction relative to a printing medium to perform printing, wherein the printing head includes a color ink nozzle row in which a plurality of nozzles ejecting a color ink are arranged in the sub-scanning direction, and a light shield ink nozzle row in which a plurality of nozzles ejecting a light shield ink are arranged in the sub-scanning direction, and wherein the light shield ink nozzle row is provided with the nozzles provided at a position overlapping with the color ink nozzle row in the main scanning direction and the nozzles provided at a position which does not overlap with the color ink nozzle row in the main scanning direction.

* * * * *